US005373338A

United States Patent [19]

Yamaguchi et al.

[11] Patent Number: 5,373,338

[45] Date of Patent: Dec. 13, 1994

[54] FILM FEEDING APPARATUS

[75] Inventors: Takuji Yamaguchi, Wakayama; Yuji Yamamoto; Hiroshi Minami, both of Wakayama, all of Japan

[73] Assignee: Noritsu Koki Co., Ltd., Wakayama, Japan

[21] Appl. No.: 44,391

[22] Filed: Apr. 8, 1993

[30] Foreign Application Priority Data

| | | | |
|---|---|---|---|
| Apr. 10, 1992 | [JP] | Japan | 4-090954 |
| Apr. 13, 1992 | [JP] | Japan | 4-092670 |
| Apr. 13, 1992 | [JP] | Japan | 4-092675 |
| Apr. 13, 1992 | [JP] | Japan | 4-092767 |
| Apr. 13, 1992 | [JP] | Japan | 4-092788 |
| Apr. 13, 1992 | [JP] | Japan | 4-092840 |

[51] Int. Cl.[5] ..... G03D 3/08

[52] U.S. Cl. ..... 354/319

[58] Field of Search ..... 354/297, 310, 313, 319–324, 354/339–341

[56] References Cited

U.S. PATENT DOCUMENTS

| | | | |
|---|---|---|---|
| 4,311,379 | 1/1982 | Famolomo | 354/319 X |
| 4,797,698 | 1/1989 | Uenaka et al. | 354/319 X |
| 5,231,439 | 7/1993 | Takahashi et al. | 354/321 X |

*Primary Examiner*—D. Rutledge

*Attorney, Agent, or Firm*—Wenderoth, Lind & Ponack

[57] ABSTRACT

A film feeding apparatus feeds films in cartridges secured to leaders into a film developing section, A film insertion box provided adjacent to the film developing section has a film setting chamber and a film feeding chamber. An inlet slit is formed in the film feeding chamber. Mounted in the film feeding chamber are a first carrier device for feeding the leaders inserted into the slit downwards with the cartridges disposed thereunder, a second carrier device (50) for intermittently feeding the leaders toward a deep area of the film feeding chamber, and a third carrier device for feeding the leaders up into the film setting chamber. In the chamber are provided leader guides for guiding the leaders toward the film developing section, and an infeed device for feeding the leaders into the film developing section.

14 Claims, 14 Drawing Sheets

FILM FEEDING APPARATUS

BACKGROUND OF THE INVENTION

This invention relates to a film feeding apparatus capable of continuously feeding exposed films to the developing section of an automatic film developing machine.

Generally, when developing films in an automatic film developing machine of a type in which films are fed by a leader, as shown in FIG. 16, the end of a film 121 pulled out of a cartridge 120 is connected to a leader 122 by use of an adhesive tape 124.

The leader 122 is a flexible sheet made of a synthetic resin and having numerous square holes 123 arranged in the longitudinal direction at equal intervals. A sprocket is provided to feed the leader 122 longitudinally toward a film developing section by engaging the square holes 123.

Two rolls of film 121 are connected to one leader 122 at one time, In developing films 121, after inserting the leader 122 and the cartridge 120 into a film-setting chamber in a film insertion box provided in the automatic film developing machine and supporting the cartridge 120 with a cartridge holder, the leader 122 is moved to pull the films 121 out of the cartridges 120 and send them to the film developing section.

If the film-setting chamber is opened while the films are being fed from the film-setting chamber toward the developing section, the films will be exposed to light, Thus, when developing a large number of films, it was necessary to set films in a film setting chamber only after the former films have been completely fed into the film developing section. Thus, each pair of films may be spaced apart a long distance From the former pair of films when they are fed into the Film developing section. This is not desirable because the capacity of the film developing section is not fully utilized.

In order to solve this problem, an improved film feeding apparatus was disclosed in Japanese Unexamined Patent Publication 63-23155, in which a plurality of film cases are provided in a magazine, spaced apart from one another. The magazine is then set in the film insertion box and the films in the respective film cases are fed one after another toward the developing section.

With a film feeding apparatus which uses such a magazine, it is impossible to add films while developing films. Further, since a plurality of films are developed in a batch, a space is produced between films every time the magazine is replaced with a new one. Thus, the film developing capacity is low.

Moreover, since the magazine is detachably connected to the upper part of the film insertion box, handling is difficult. Also, when connected, a substantial part of the magazine protrudes outward. This leads to an increase in the entire size of the automatic film developing machine and thus an increase in the installation space. Also, if films have to be developed one at a time, the magazine has to be removed. Thus, it is necessary to provide an extra space for storing such removed magazines.

SUMMARY OF THE INVENTION

An object of this invention is to provide a compact film feeding apparatus which is free of the above problems and which can feed films continuously to the film developing section.

According to the present invention, there is provided a film feeding apparatus for feeding a film, pulled out of a cartridge and secured to a leader, into a film developing section. The film feeding apparatus comprises a film setting chamber communicating with the film developing section. A film feeding chamber has in its top a slot through which leaders with cartridges are fed. A first carrier device is provided in the film feeding chamber for feeding a leader with a cartridge downward with the cartridge disposed under the leader. A second carrier device is provided in the film feeding chamber for intermittently feeding the leader, which has been fed to a lower part of the film feeding chamber by the first carrier device; toward a deeper area of the film feeding chamber. A third carrier device is provided in the film feeding chamber for feeding the leader, which is at the delivery end of the second carrier device toward the film setting chamber. A leader guide is provided in the film setting chamber for guiding the leader fed into the film setting chamber to the film developing section, and an infeed device is provided in the film setting chamber for feeding the leader into the film developing section.

With this arrangement, by feeding leaders with cartridges containing film continuously into the slot, the leaders with cartridges can be fed one after another into the film developing section. This improves the capacity of the automatic film developing machine.

Also, since the film setting chamber is provided under the film feeding chamber, the entire size of the automatic film developing machine can be reduced.

The first carrier device in the film feeding chamber may comprise a carriage for supporting the bottom edge of the leader, and a driving device for moving the carriage vertically. Such a carriage may be provided with a support member to prevent the cartridge which hangs from the leader from falling, thus preventing the film therein from being pulled out of the cartridge and being exposed to light.

In another arrangement, the support member has its rear end pivotally connected to the carriage, a roller is mounted on the support member at a portion before and below the center of pivoting motion of the support member, roller guide grooves are provided so as to extend vertically along the vertical path of the carriage to control the position of the support member by guiding the roller, and the lower portion of each roller guide groove is in the form of an inclined guide path to cause the support member to be swung downward.

In this arrangement, even if the cartridge under a leader which has been fed into the second carrier device is located near the path of leaders fed by the first carrier device, the cartridge will never interfere with the support member. Thus, a plurality of leaders can be supported by the second carrier device.

The film feeding apparatus may further comprise a detector provided along the path of the leader being fed downward by the first carrier device for detecting the curling amount of the leader, and a control device for controlling the second carrier device based on the detection signal from the detector, This arrangement makes it possible to remove, before being fed into the film developing section, any leader which is considerably curled and thus likely to get stuck while being fed, The second carrier device may comprise a pair of leader guide driving devices, each of the leader guide driving devices comprising a pair of rotary shafts, pulleys mounted on the rotary shafts at upper and lower portions thereof, belts each put around the upper pulleys and the lower pulleys, and a plurality of leader guides each having a vertically elongated support groove to receive one of the side edges of the leader and arranged between the upper and lower belts at equal intervals.

The film feeding apparatus may further comprise a detector provided under the path of the leader and cartridge fed by the second carrier device for detecting the fall of the cartridge, and an alarm means for giving an alarm upon the fall of a cartridge based on the detection signal of the detector. With this arrangement, an operator can close the slot with the lid before the film is exposed to light. Films are thus prevented from being exposed to light.

A film feeding apparatus may further comprise a first detector for detecting a leader or cartridge that is supported by a leader guide facing the first carrier device of the leader guide driving units, a second detector for detecting a leader or cartridge supported by a leader guide facing the third carrier device, and a control device for moving the leader guides toward the first carrier device until a leader or cartridge is detected by the first detector and then moving the leader guides by one pitch toward the third carrier device if the supply of leaders into the slot is temporarily stopped and then resumed. As a result, no leader or cartridge is detected by the first detector while the second detector detects a leader or cartridge.

With this arrangement, though some leader guides are driven in an empty state toward the third carrier device if the supply of leaders is temporarily stopped, once the supply of leaders is resumed, it is possible to set leaders in these empty guides, Thus, the subsequent film processing can be carried out efficiently with no waste of time.

The third carrier device may comprise a carriage for supporting the bottom edge of the leader and a driving device for moving the carriage up and down.

Also, the film feeding apparatus may further comprise a film detector provided along the path of the leader fed upward by the third carrier device for detecting if the film has been pulled out of the cartridge, and a control device for controlling the infeed device based on the detection signal of the film detector. This arrangement makes it possible to remove any film that has been pulled out of the cartridge before being fed into the film setting chamber. Thus, films are protected against damage.

The film feeding apparatus may further comprise a detector for detecting whether or not a leader immediately behind a leader being fed upward by the third carrier device has been fed upward together with the former leader. The detector is provided over the leader immediately behind the leader being fed upward, and a control device controls the drive unit of the third carrier device based on the detection signal from the detector. This arrangement can prevent any two adjacent leaders from being fed into the film setting chamber at a time.

BRIEF DESCRIPTION OF THE PREFERRED EMBODIMENT

Figure 1:
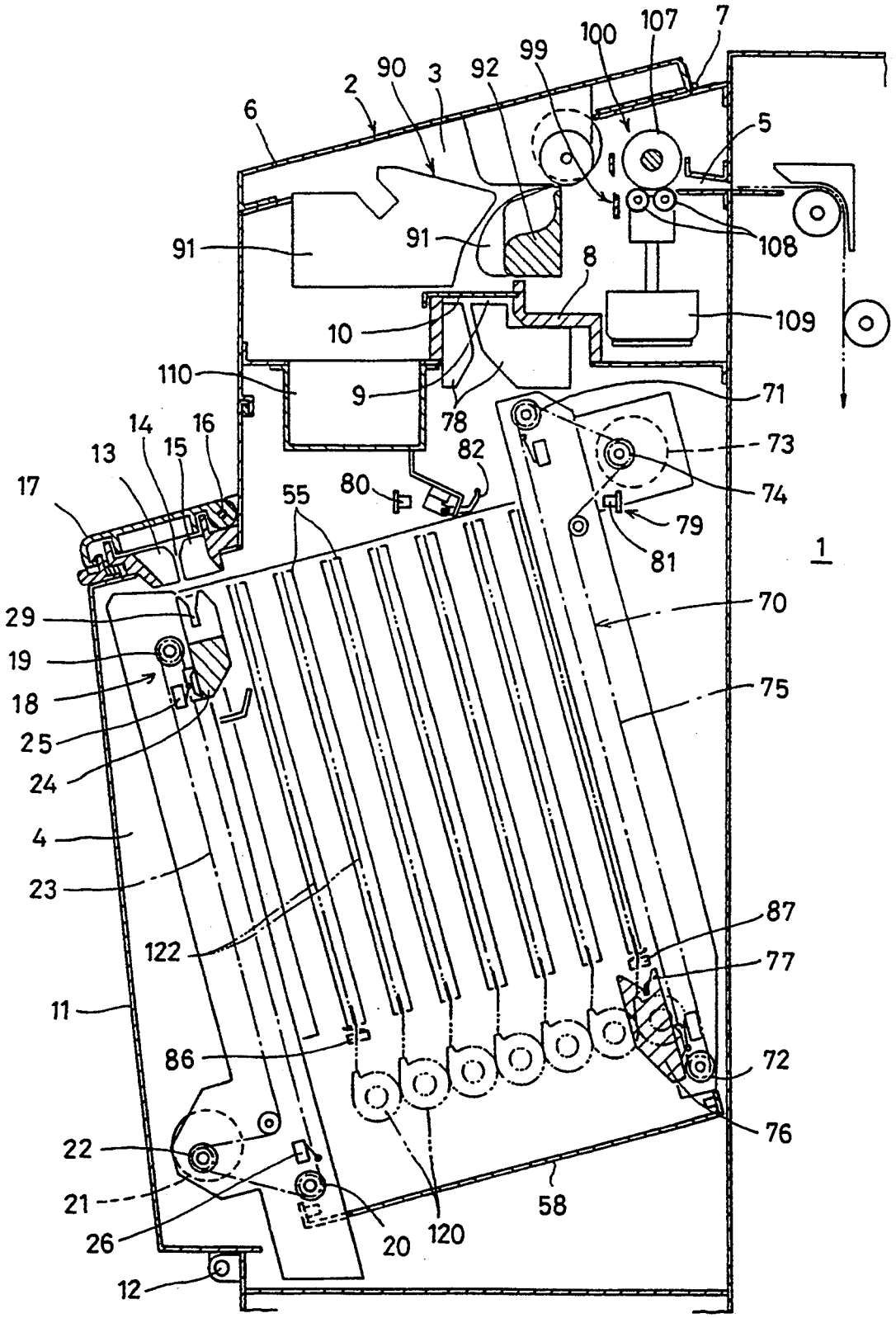
FIG. 1 is a vertical sectional front view showing schematically a film feeding apparatus according to this invention.

As shown in FIG. 1, a film insertion box 2, which is provided next to a film developing section 1, is partitioned into a film setting chamber 3 and a film feeding chamber 4.

The film setting chamber 3 communicates with the film developing section 1 through a passage 5. It has a lid 6 on the top, The lid 6 is pivotable about a pin 7.

The film setting chamber 3 and the film feeding chamber 4 are partitioned by a partitioning plate 8 having an opening 9 which is closed by a shutter 10.

The film feeding chamber 4 has a cover 11 on the front thereof. The cover 11 is pivotable about a pin 12 and has a slot 13 through which a leader 122 and a cartridge 120 (shown in FIG. 16) are inserted. The slot 13 is closed by a lid 17 pivotable about a pin 16. The leader 122 and cartridges 120 are inserted with the cartridges 120 located under the leader 122.

In the film feeding chamber 4 is mounted a first film carrier device 18 for feeding the leader 122 inserted through the slot 13 downwards. The film carrier device 18 comprises toothed pulleys 19 and 20 which are provided at upper and lower portions, respectively, in the film feeding chamber 4, a toothed pulley 22 driven by a motor 21, a timing belt 23 put around the pulleys 19, 20 and 22, and a carriage 24 secured to the timing belt 23. The carriage 24 can be moved up and down by driving the motor 21.

Limit switches 25 and 26 are provided at the upper and lower ends of the path of the carriage 24, respectively. When the carriage 24 reaches the upper or lower end, the limit switch 25 or 26 is activated, thereby stopping the motor 21.

Figure 2:
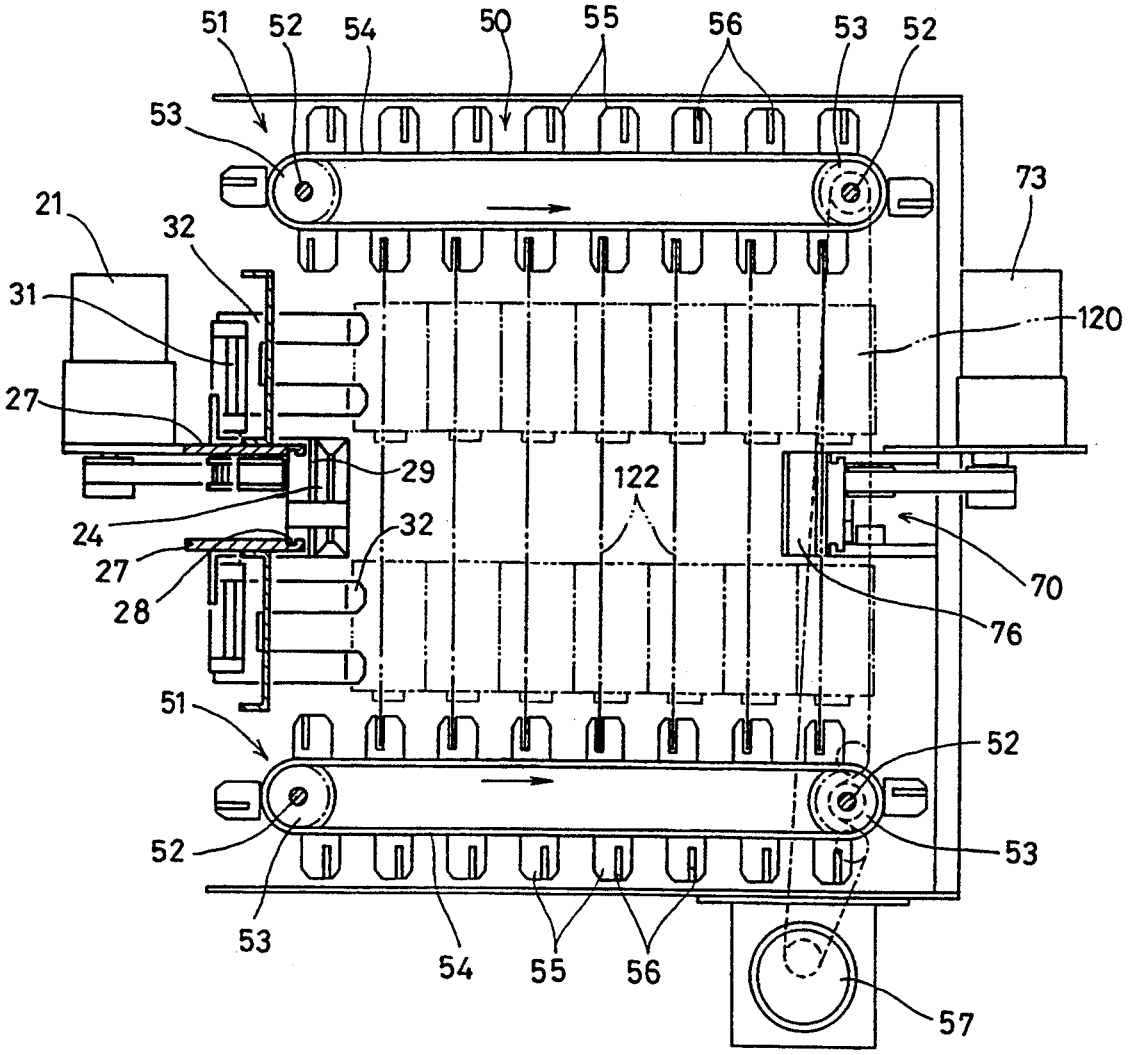
FIG. 2 is a plan view of the leader carrier devices mounted in a film feeding chamber of this device.
Figure 3:
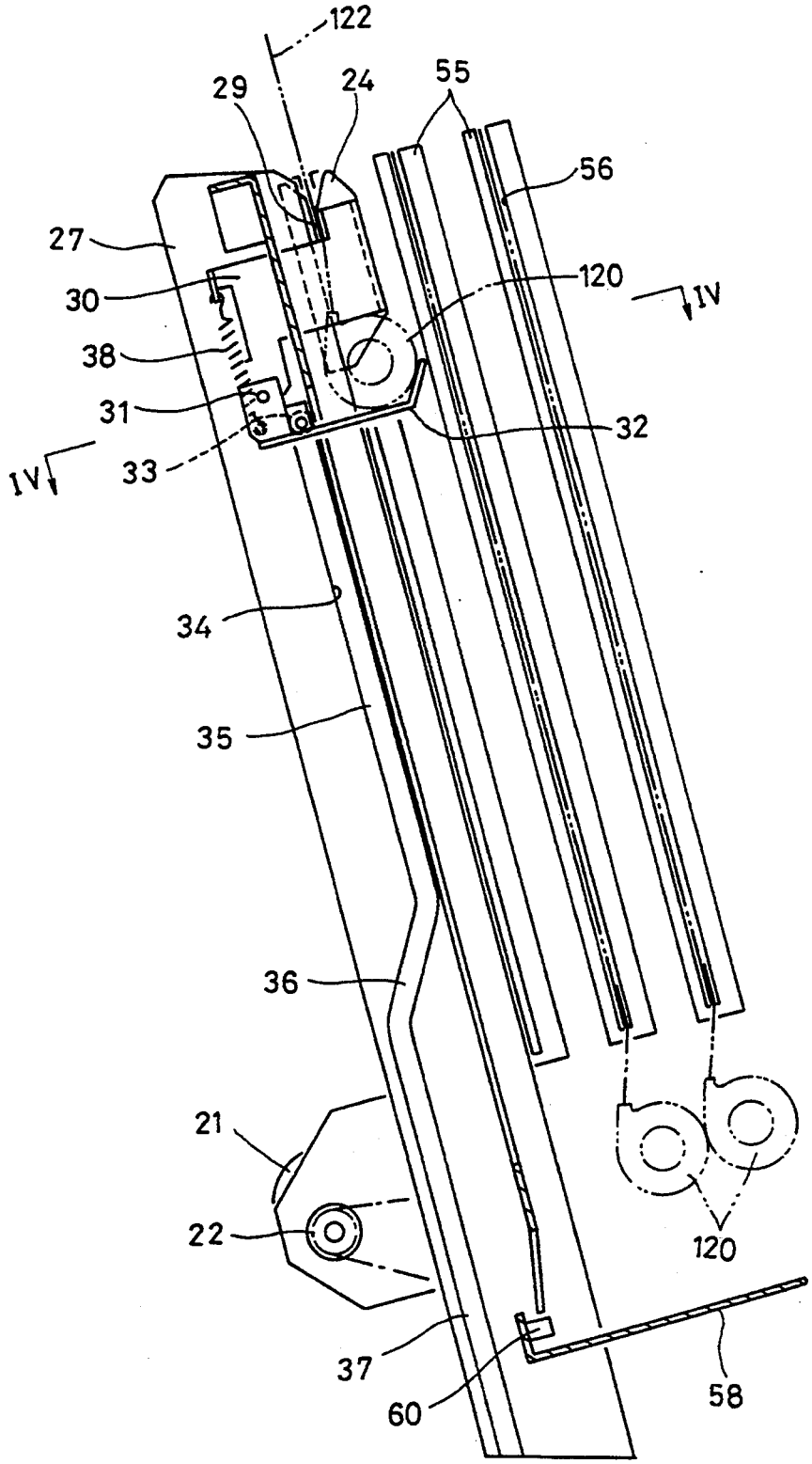
FIG. 3 is a front view showing a first carrier device.
Figure 4:
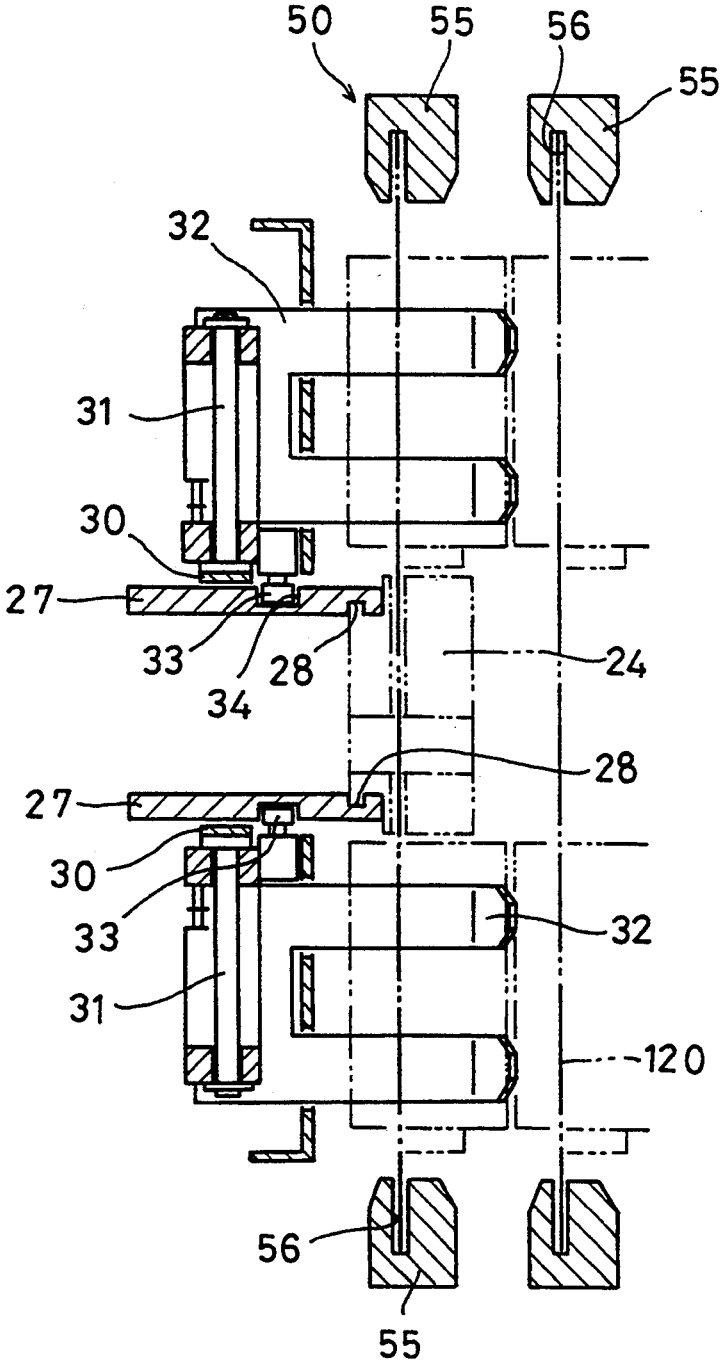
FIG. 4 is a sectional view taken along line IV—IV of FIG. 3.

As shown in FIGS. 2 to 4, a pair of vertical guide plates 27 are provided on both sides of the path of the carriage 24. The guide plates 27 have vertically elongated guide grooves 28 in their surfaces opposed to each other (FIG. 2), The carriage 24 is moved up and down along the guide grooves 28.

Figure 5:
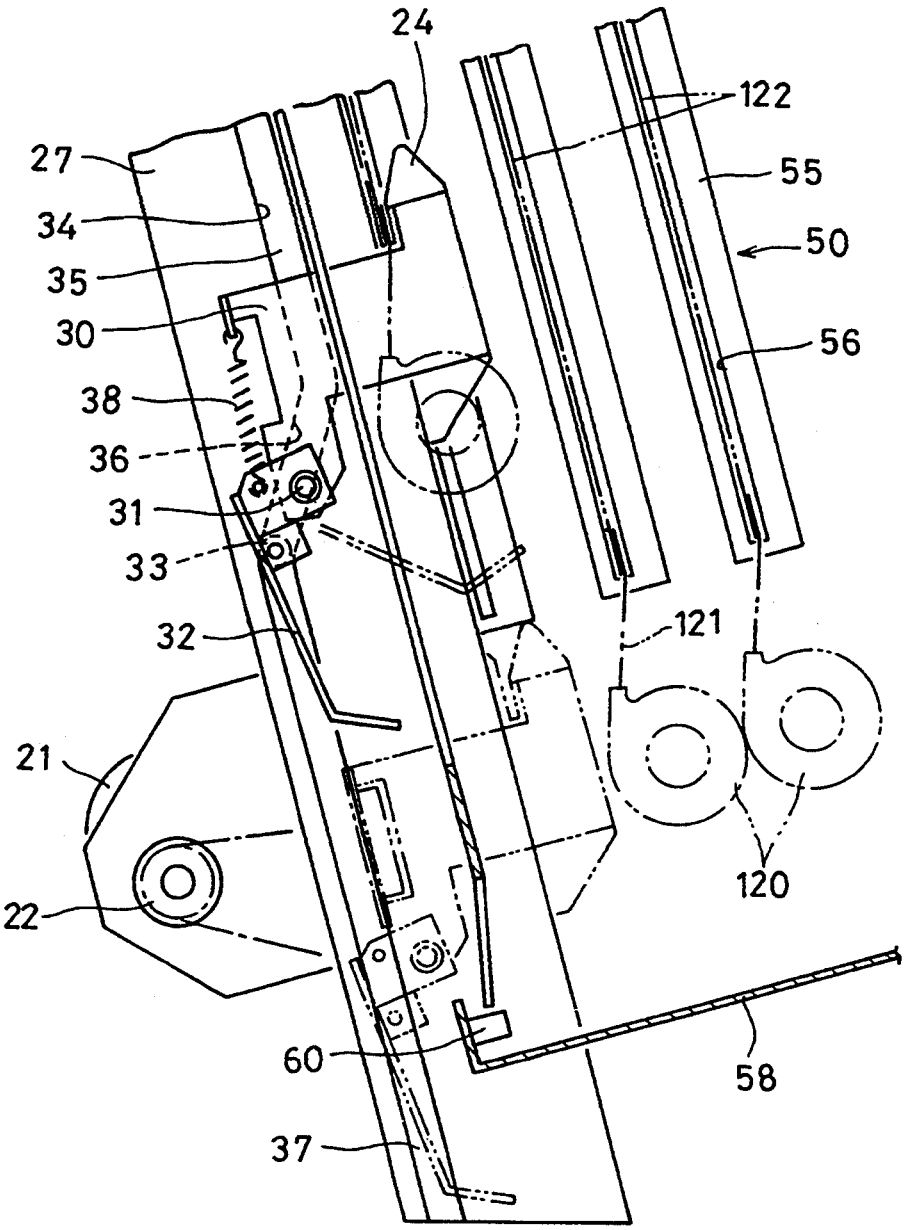
FIG. 5 is a front view showing how the first carrier device operates.

The carriage 24 has on the top surface thereof a guide groove 29 to support the leader 122 at the center of its bottom edge, It is also provided with a pair of support plates 30 at both sides thereof (FIG. 5). A pin 31 is provided on the lower part of the outer surface of each support plate 30. Supports 32 For supporting the cartridge 120 have their rear ends pivotably supported on the respective pins 31 (FIG. 5).

A roller 33 is rotatably mounted on the inner surface of each support 32 in front of and below the pin 31. On the other hand, the guide plates 27 have roller guide grooves 34 for guiding the rollers 33 and thus controlling the position of the supports 32.

Each roller guide groove 34 comprises an upper guide path 35, an inclined guide path 36 and a lower guide path 37. The upper guide path 35 and the lower guide path 37 extend in parallel to the guide grooves 28 for guiding the movement of the carriage 24. While each roller 33 is moving along the upper guide path 35, the support 32 is kept substantially horizontal. While each roller 33 moving along the inclined guide path 36, the support 52 is inclined downwards. While each roller 33 is moving along the lower guide path 37, the support 52 remains inclined downwards. A spring 38 urges the rear part of each support 32 upwards.

Figure 6:
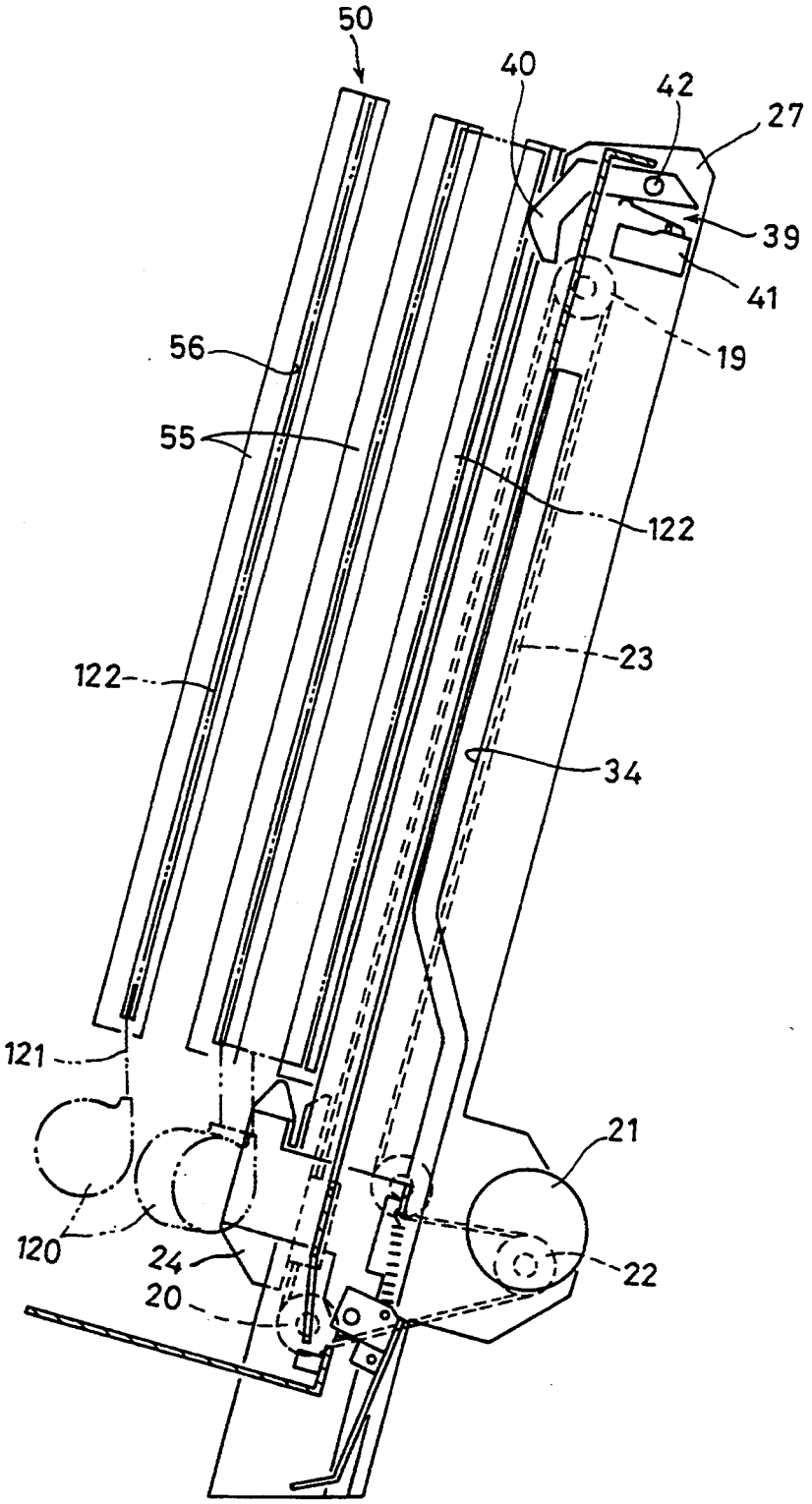
FIG. 6 is a Fear view showing how a detector for detecting the amount of curling leaders is mounted.

As shown in FIG. 6, one of the guide plates 27 carries on its outer surface a detector 39 for detecting the curling amount of the leader 122 while it is being fed downward by the carriage 24. This detector 39 comprises a leader detecting arm 40 and a switch 41. The leader detecting arm 40 has its rear end pivotally supported on a pin 42. Its front end protrudes into the path of the leader 122, which is fed downwards by the carriage 24. When the leader 122 is fed downwards, it pushes and swings the arm 40, thus activating the switch 41.

Figure 16:
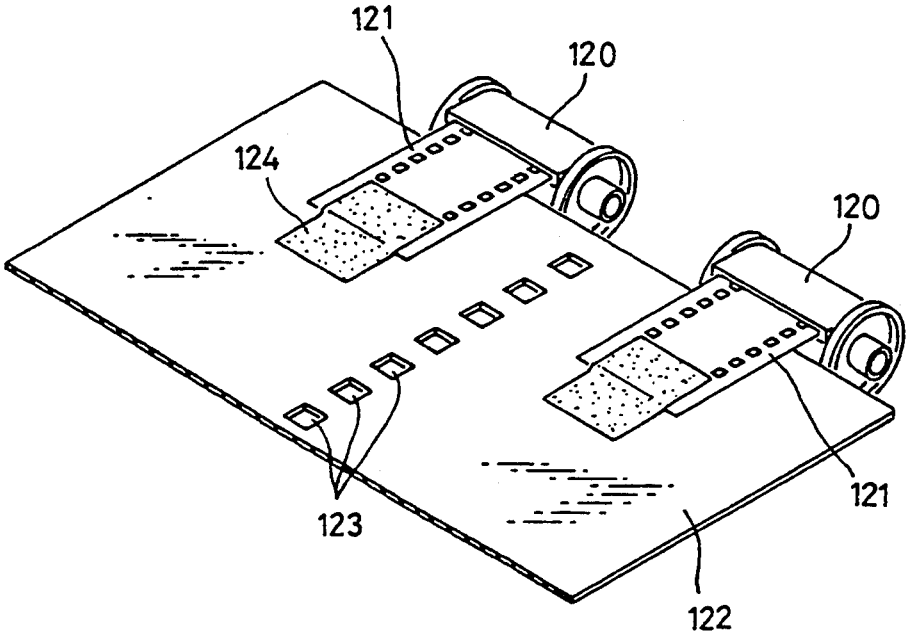
FIG. 16 is a perspective view showing how a film is connected to a leader.

With the carriage 24 of the first carrier device 18 at a stop in its upper position, the leader 122 shown in FIG. 16 is inserted into the slot 13 together with the cartridge 120 disposed below it. The bottom edge of the leader 122 is inserted in the support groove 29, whereupon a switch (not shown) is activated and the motor 21 is activated, so that the carriage 24 and the leader 122 attached thereto begin to descend.

When the supports 32 begin to descend, the rollers 33 mounted on the supports move along the upper guide paths 35 of the roller guide grooves 34, keeping the supports 32 substantially horizontal. The cartridge 120, supported on the supports 32, is fed downwards.

Thus, while the leader 122 is descending, the cartridge 120 is prevented from falling from the supports 32, so that the film 121 in the cartridge 120 will be never pulled out.

When the rollers 33 enter the inclined guide paths 36, the supports 32 are inclined downwards as shown in FIG. 5, thus separating from the cartridge 120.

The rollers 53 then move into the lower guide paths 37, where the supports 32 are kept substantially vertical. When the carriage 24 moves further down and activates the lower limit switch 26, the motor 21 stops.

When the leader 122 reaches the lower part of the film feeding chamber 4, it is then moved intermittently for a predetermined stroke toward a deeper part of the film feeding chamber 4 by means of a second carrier device 50 (FIG. 5).

Figure 7:
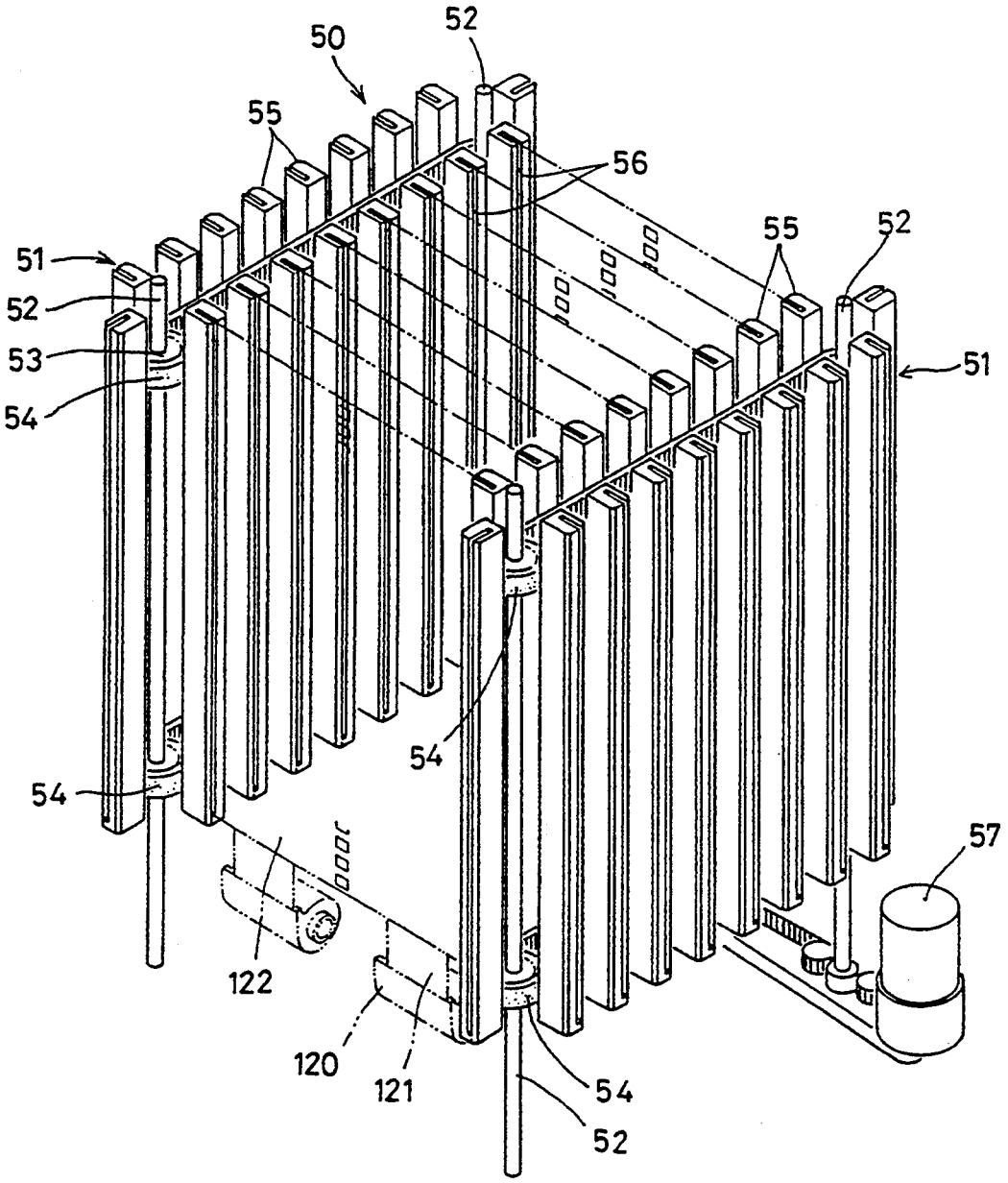
FIG. 7 is a perspective view showing a second carrier device shown in FIG. 1.

FIGS. 2 and 7 show the details of the second carrier device 50, It comprises a pair of driving units 51 for leader guides.

Each leader guide driving unit 51 comprises a pair rotary shafts 52, toothed pulleys 55 mounted on upper and lower portions thereof, and a pair of timing belts 54, one put around the upper pair of pulleys 53 and the other put around the lower pair. Leader guides 55 are secured to the timing belt 54 at equal intervals, Each leader guide 55 is formed with a vertically extending support groove 56.

The right and left leader guide driving units 51 are simultaneously driven by a single motor 57 simultaneously. The leader guides 55 are fed intermittently in the direction of the arrows shown in FIG. 2, the feed stroke being equal to the distance between the adjacent leader guides 55.

The pair of leader guide driving units 51 are arranged so that one opposed pair of the leader guides 55 are located under and on both sides of the slot 13 (FIG. 1), so that the leader 122 inserted into the slot 13 is received on both sides in the support grooves 56 in the leader guides 55 (FIG. 7). Thus, while the leader 122 is being fed downwards, both its sides are guided along the support grooves 56 formed in a pair of leader guides 55.

The bottom surface of the support groove 56 formed in each leader guide 55 is slightly above the lower limit of the stroke of the carriage 24, Thus, the leader 122, which is being fed downward by the carriage 24, abuts the bottoms of the support grooves 56 slightly before the carriage 24 stops at its lower stroke limit. The leader 122 is thus handed over from the first carrier device 18 to the second carrier device 50.

The supports 32 of the carriage 24 take a substantially vertical position just before the bottom edge of the leader 122 abuts the bottoms of the support grooves 56. Thus, even if a leader 122 that has been fed earlier by the second carrier device 50 is located close to the next leader, the supports 32 will not interfere with the cartridge 120, Thus, it is possible to shorten the pitch between the leader guides 55. A shorter pitch means that a greater number of leader guides 55 can be provided, which in turn makes it possible to support a greater number of leaders 122 with the second carrier device 50.

If the pitch between the leader guides 55 is so large that the supports 32 will not interfere with the cartridge 120 even if they are moved down and maintained in a substantially horizontal position, the supports 32 may be fixedly mounted to the carriage 24.

Once the leader 122 is handed over from the first carrier device 18 to the second carrier device 50 and the lower limit switch 26 is activated by the carriage 24 of the first carrier device 18, the pair of leader guide driving units 51 are now driven by the motor 57 and the leader 122 is fed intermittently into a deeper area of the film feeding chamber 4. The length of each intermittent travel is equal to the mounting pitch between the leader guides 55.

If the leader 122 being fed by the second carrier device 50 is a flat normal leader, the switch 41 of the detector 39 shown in FIG. 6 will be turned from ON to OFF as the leader 122 moves on.

Figure 8:
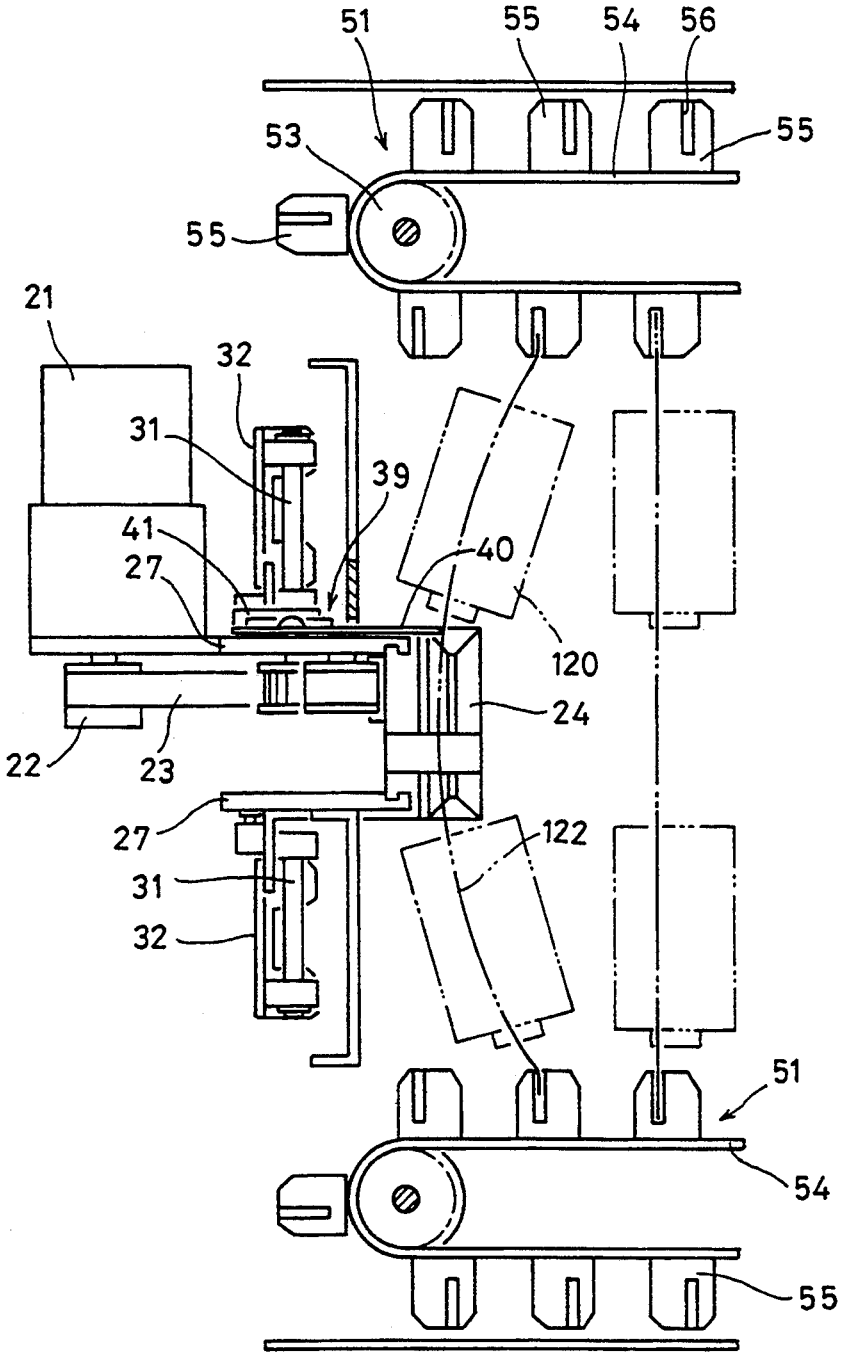
FIG. 8 is a plan view showing how the detector shown in FIG. 6 operates.

If, however, the leader 122 is an abnormal one which is curved in the direction of width as shown in FIG. 8, the switch 41 will be kept turned ON while the leader 122 is being fed.

If the switch 41 fails to turn from ON to OFF while the leader 122 is being fed by the second carrier device 50, the control device stops the leader by controlling the motor 21 of the first carrier device 18, It also activates a warning device and indicates on a display that the leader is unusable.

Every time a leader 122 is fed from the first carrier device 18 to the second carrier device 50, it is fed toward a deeper area of the film feeding chamber 4 by the second carrier device 50.

Figure 9:
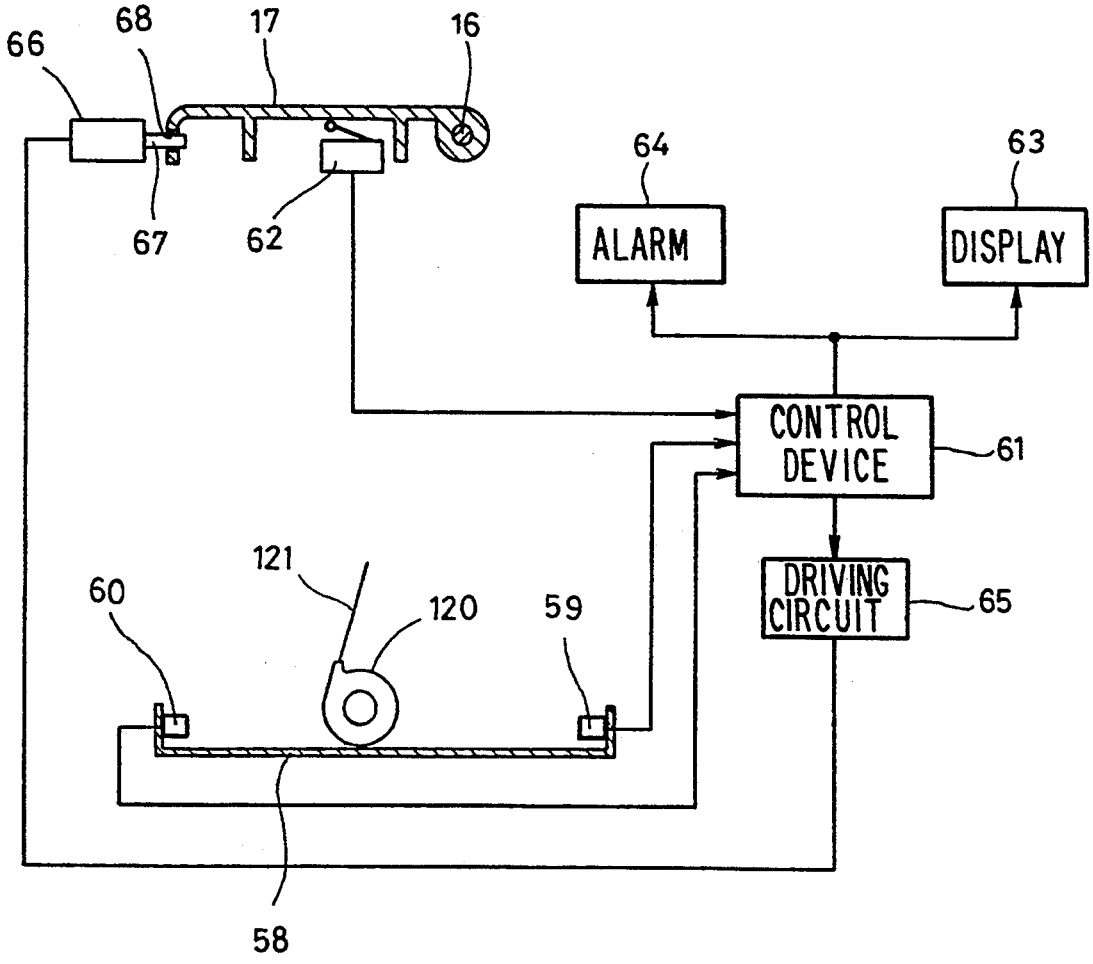
FIG. 9 is a block diagram showing the operation of a detector for detecting the fall of a cartridge.

Under the path of the leader 122 being fed by the second carrier device 50 is provided a pan 58 (FIG. 9) which serves to catch any cartridge 120 that may fall from the leader 122 which is being fed by the second carrier device 50 and thus prevent the film 121 in the cartridge 120 from being pulled out.

In the front and rear of the pan 58, a cartridge detector is provided which comprises a light emitter 59 and a light receptor 60. If the cartridge detector detects a cartridge 120, a detection signal is inputted to a control device 61 shown in FIG. 9.

If the lid 17 for closing the slot 13 is open, which is detected by a lid detector 82, the control device 61 controls a display 63 to indicate that the lid 17 has to be closed and at the same time activates an alarm 64

On the other hand, if the lid detector 62 indicates that the lid 17 for closing the slot 13 is closed, the control device 61 activates a Locking mechanism 66, comprising a solenoid, through a driving circuit 65 for locking lid 13. When the solenoid is excited by the driving circuit 65, the tip of a plunger 67 engages in an engaging hole 68 formed in the lid 17.

Once the leader 122 is fed into the deeper area of the film feeding chamber 4, it is then fed upwards by a third carrier device 70 (FIG. 1) and then enters the film setting chamber 3 through the opening 9, Every time one leader 121 is sent out by the third carrier device 70, another leader 121 is fed by one pitch toward the deeper part of the film feeding chamber 4 by the second carrier device 50.

Figure 11:
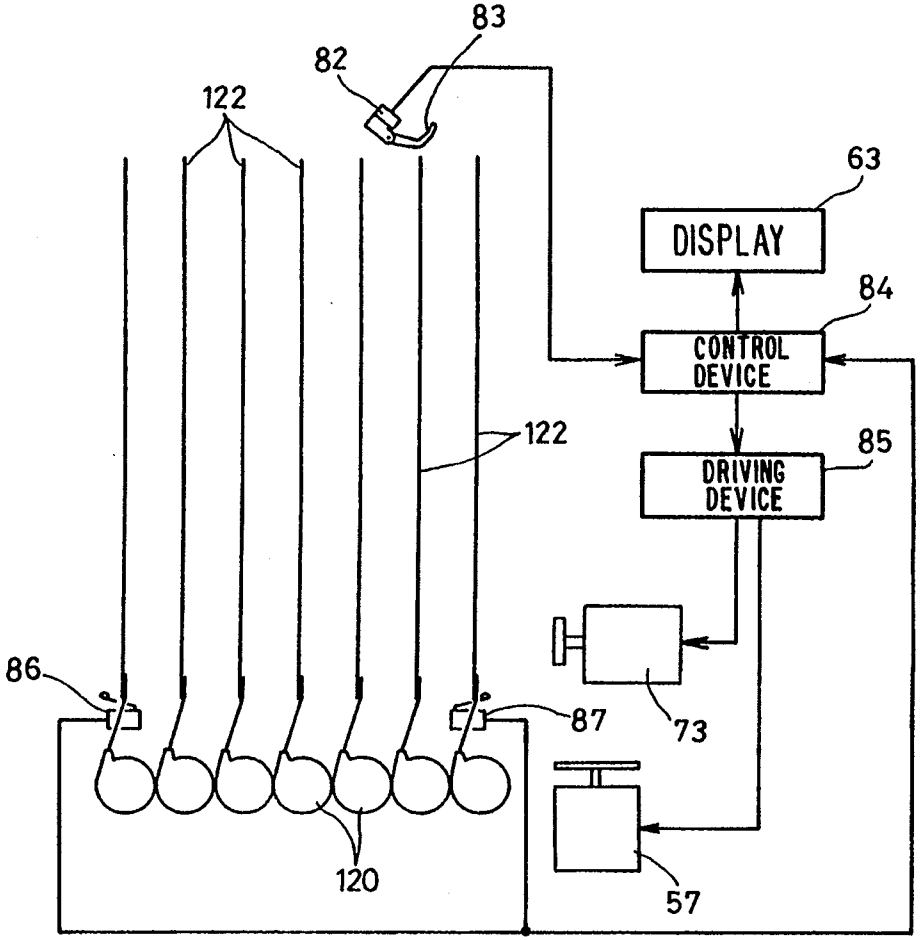
FIG. 11 is a block diagram showing the operation of the detector for detecting whether or not two leaders are being fed simultaneously.
Figure 13:
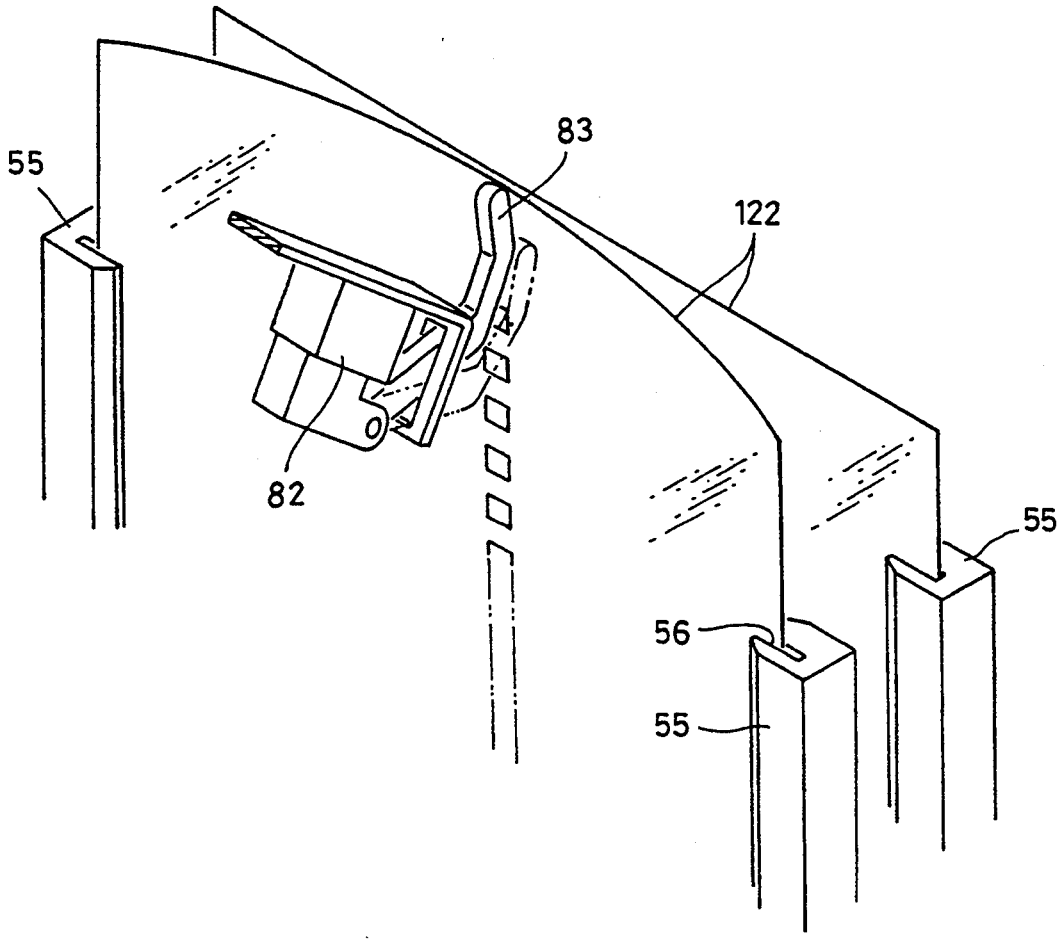
FIG. 13 is a perspective view of the arrangement shown in FIG. 12.

In this arrangement, in which every time one leader 122 is discharged by the third carrier device 70, and the leaders 122 are fed one pitch deeper into the film feeding chamber 4 by the leader guide driving units 51, if the supply of fresh leaders 122 through the slot 13 is temporarily stopped, some of the leader guides will be driven in an empty state by the leader guide driving units 51, When the supply of leaders 122 is resumed, such empty guides will cause a delay in the processing of films thereafter. In order to prevent this problem, as shown in FIG. 11, the leader guide driving units 51 are provided with a first detector 86 and a second detector 87 for detecting the leaders 122 supported by the leader guides 55. These detectors are Located near the first carrier device 18 and the third carrier device 70, respectively.

The first detector 86 and the second detector 87 each have a swing lever. The detectors are activated when their respective levers are pushed down by the leaders 122 supported by the leader guides 55. The detection signals are inputted to a control device 84.

The control device 84 detects that some of the leader guides driven by the leader guide driving units 51 are empty based on the detection signals from the detectors 86 and 87, after the supply of leaders 122 through the slot 13 has been stopped and then resumed (in order that the control device 84 can detect the fact that the supply of leaders has been resumed, the film feeding apparatus may be provided with a supply restart switch which is activated when the supply of leaders is resumed and is adapted to notify this fact to the control device 84).

Namely, if no leader 122 is detected by the first detector 86 while the second detector 87 detects a leader, it is detected that some of the leader guides 55 are empty.

If this is detected, the control device 84 will activate a driving device 85 to rotate the motor 57 in such a reverse direction that the leader guides 55 are moved toward the first carrier device 18 until a leader 122 is detected by the first detector 86.

Once a leader guide 55 carrying a leader 122 is detected by the first detector 86, the control device 84 will drive the motor 57 in a normal direction through the driving device 85 to move the leader guides 55 by one pitch toward the third carrier device 70. In this state, a pair of empty leader guides are located at the end of the row of leader guides facing the first carrier device 18.

In this state, leaders 122 are again fed through the slot 13 one after another. Every time one leader 122 is fed to the next station by the third carrier device 70, the leaders 122 in the film feeding chamber 4 are fed one pitch deeper. In this way, leaders 122 fed into the film setting chamber 4 after a temporary stop of the supply of leaders 122 are set in the leader guides which carry no leaders due to the temporary stop of the supply of leaders. Thus, films can be processed efficiently in the next steps without any waste of time.

The number of intermittent movements of the leader guides may be counted by the control device 84 (a sensor for detecting the leader guides 55 may be provided to count the number of intermittent movements. The number of intermittent movements thus counted can be used to calculate the number of empty guides and indicate on the display 63 the number of leaders that can be supplied into the chamber 4. Thus, the supply of leaders can be controlled efficiently.

In the above embodiment, the detectors 86 and 87 are used to detect leaders 122. But they may be used to detect cartridges 120. Also, the detectors 86 and 87 may be photosensors, which can detect leaders 122 or cartridges 120 without contacting them.

As shown in FIG. 1, the third carrier device 70 comprises toothed pulleys 71 and 72 provided at upper and lower parts of the film feeding chamber 4, a toothed pulley 74 driven by a motor 75, a timing belt 75 put around the pulleys 71, 72 and 74, and a carriage 76 secured to the timing belt 75. The carriage 76 is moved up and down by driving the motor 73.

The carriage 76 is moved up and down between the pair of leader guide driving units 51 (FIG. 7) and has in the top thereof a support groove 77 to support the bottom edge of a leader 122.

The carriage 76 of the third carrier device 70 moves up every time the leader 122 is fed toward the deeper part of the film setting chamber 4, The leader 122 is thus fed upwards. At this time, the shutter 10 is moved to a position opening the opening 9 (FIG. 1), The leader 122 is thus fed into the film setting chamber 3 through the opening 9.

Under the opening 9 is provided a leader guide 78. The leader 122 is fed into the opening 9 guided by the leader guide 78. The leader guide 78 comprises a plurality of pairs of guide plates, Each pair of guide plates are spaced apart from each other by a distance sufficient for the leader 122 to pass therethrough, The guide plates in each of the rows are arranged in the direction of width with the adjacent plates being spaced apart from each other by a distance sufficient for the cartridge 120 to pass through.

Figure 10:
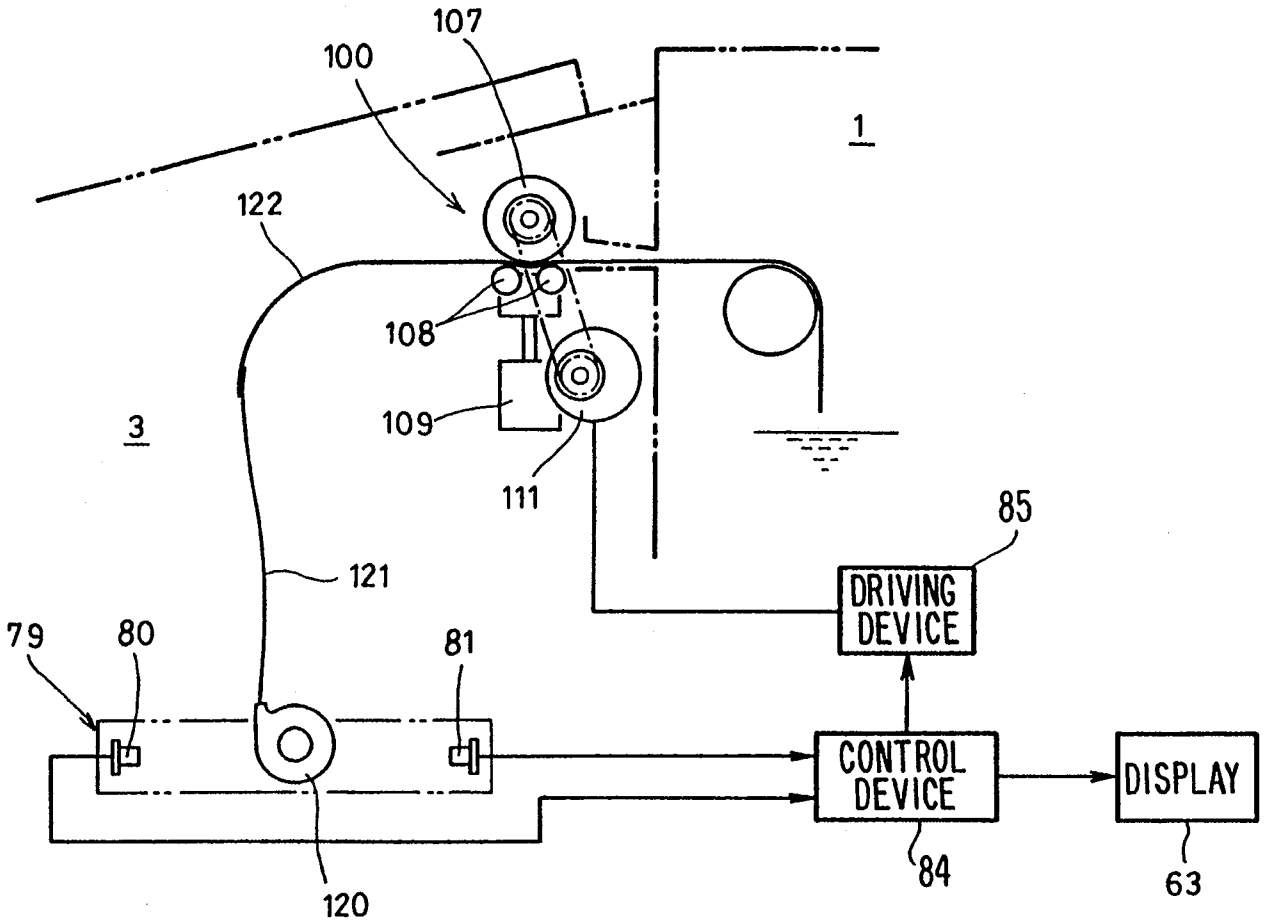
FIG. 10 is a block diagram showing the operation of a detector for detecting whether films are pulled out.

As shown in FIGS. 1 and 10, there is provided, along the path of the leader 122 fed upward by the third carrier device 70, a film detector 79 for detecting if the film 121 should be pulled out of the cartridge 120 being fed upward together with the leader 122.

The film detector 79 comprises a light emitter 80 and a light receptor 81, This film detector 79 detects if the film 121 has been pulled out of the cartridge 120 by measuring the time during which the transmission of light is intercepted while the leader 122, film 121 and cartridge 120 are passing therethrough. A detection signal is inputted in to the a control device 84 shown in FIG. 10.

If the film detector 79 detects that the film 121 has been pulled out, the control device 82 controls the display 63 to indicate that the film 121 has been pulled out and at the same time stops a film infeed device provided in the film setting chamber 3, which is to be described hereinafter, by activating the driving device 85.

By stopping the film infeed device, the leader 122 cannot be fed into the film developing section 1. The film 121 is thus protected against damage.

The leader 122, which is now at a standstill, can be taken out of the film setting chamber 3 by opening the lid 6. Before taking out the leader, it is necessary to attach a light shield bag to keep the film setting chamber 3 in a dark state.

Figure 12:
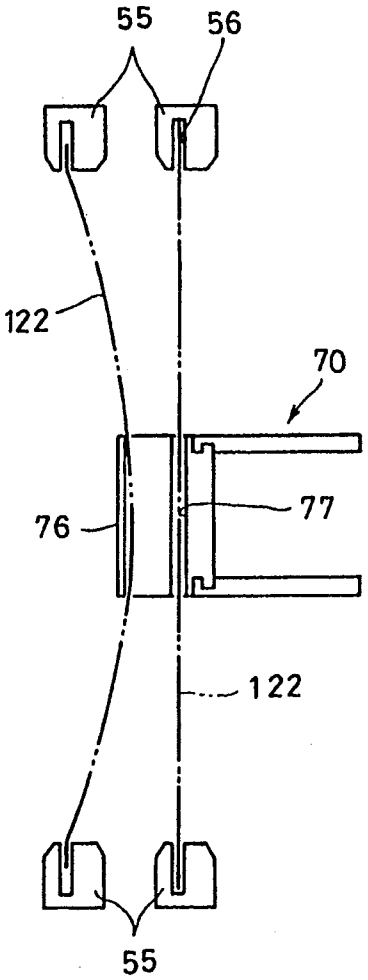
FIG. 12 is a plan view of a third carrier device showing how it feeds leaders upward.

When feeding a leader 122 by the third carrier device 70, if the leader just behind this leader is an abnormal one which is warped in the direction of width, as shown in FIG. 12, in the direction opposite to the direction of warp shown in FIG. 8, these two leaders 122 might be fed upward together by the carriage 76 of the third carrier device 70.

in order to prevent two adjacent leaders 122 from being fed at a time, as shown in FIGS. 11 and 12, a detector 82 is provided over the leader immediately behind the leader to be fed upward by the third carrier device 70. This detector serves to detect if these two leaders are being fed together.

The detector 82 has a pivotable lever 83. If the front two leaders 122 are fed upwards together, the lever 76 is pushed up by the rear leader to activate the detector 82.

If the detector 82 detects that the two leaders are being fed upwards at a time, a detection signal is inputted to the control device 84. If the detector 82 is activated, the control device 84 stops the motor of the third carrier device 70 by activating the driving device 85 and causes the display 63 to indicate that the two leaders 122 are being fed upward at a time.

This arrangement can prevent two leaders 122 from being fed into the film setting chamber 3 at a time and thus can prevent the leaders from getting stuck while being fed.

Figure 14:
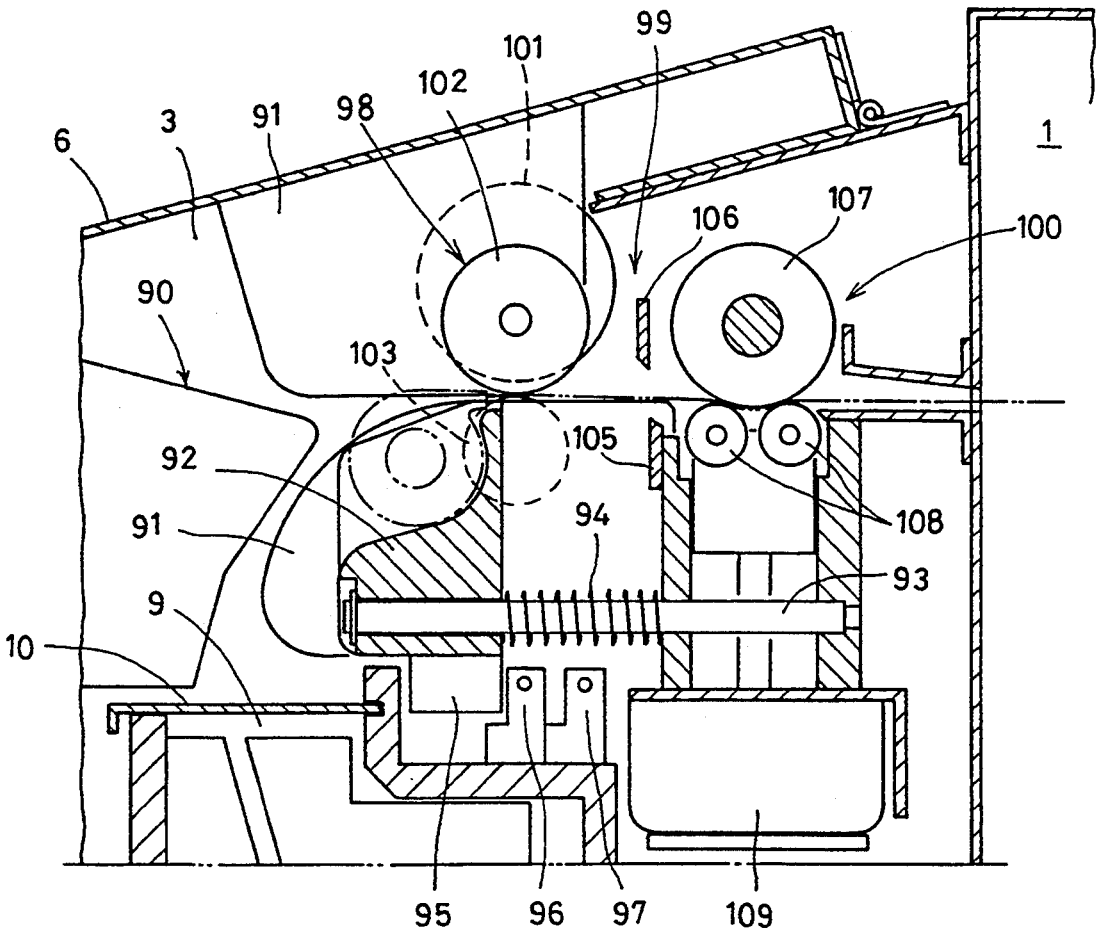
FIG. 14 is a vertical sectional front view showing the structure of a film setting chamber.
Figure 15:
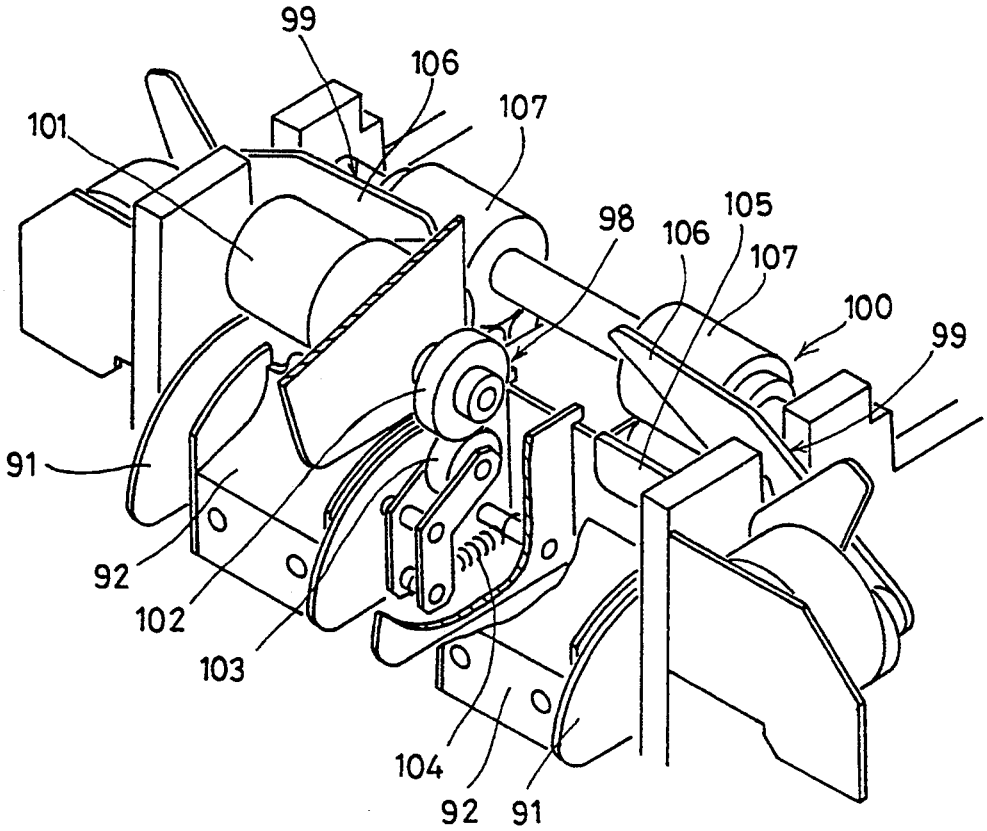
FIG. 15 is a perspective view showing a leader guide, cutter device and infeed device of FIG. 14.

FIGS. 14 and 15 shows the details of the film setting chamber 3 in which is provided a leader guide 90 for changing the direction of feed of the leaders 122 fed into the chamber 3 by the third carrier device 70 and guiding them toward the film developing section 1.

The leader guide 90 comprises several sets of guide plates 91, each set comprising three guide plates which are spaced apart from each other by a distance sufficient for the leaders 122 to pass therethrough, The respective sets extend in the direction of width of the leaders 122 so as to be parallel to one another and spaced apart from each other by a distance sufficient for the cartridge 120 to pass therethrough.

Cartridge holders 92 are provided between the adjacent guide plates 91 disposed on the side near the film developing section 1 (FIG. 15), Each cartridge holder 92 is slidably supported on a guide rod 93 extending toward the film developing section 1 and is urged by a spring 94 in a direction away from the film developing section 1.

A detecting piece 95 is mounted on the underside of each cartridge holder 92. Along the path of the detecting piece 95, first and second detectors 96 and 97 are provided to detect the detecting piece 95.

Along the path of leaders extending from each cartridge holder 92 to the film developing section 1, there are provided a fast feed device 98 for leaders 122, a cutter device 99 for cutting the film 121 pulled by each leader 122, and an infeed device 100 for feeding leaders 122 into the film developing section 1, which are disposed in this order with respect to the direction of feed of leaders 122.

The fast feed device 98 comprises a drive roller 102 driven by a motor 101 and a pressure roller 103 provided under the driving roller 102 and pressed against the drive roller 102 by a spring 104.

The cutter device 99 comprises a fixed lower knife 105 and an upper knife 106 movable up and down with respect to the lower knife.

When a leader 122 is fed into the film setting chamber 3 by the third carrier device 70, it is guided by the leader guide 90 toward the film developing section 1. The leader 122 is inserted between the driving roller 102 and the pressure roller 103 of the fast feed device 98 and fed at high speed. It is then inserted between a driving roller 107 and a pressure roller 108 of the infeed device 100 and fed into the film developing section 1.

As the leader 122 moves, the cartridge 120 that follows the leader is supported on the cartridge holder 92. As the leader 122 is fed further ahead with the cartridge 120 supported on the cartridge holder 92, the film 121 is pulled out of the cartridge 120. By the tension applied to the film 121 when pulling it out, the cartridge holder 92 is fed toward the film developing section 1.

When the detecting piece 95 for the cartridge holder 92 moves to the position of the first detector 96 and is detected by the first detector 96, a solenoid is activated, pressing the pressure rollers 108 against the driving roller 107. The film 121 is thus fed into the film developing section 1.

When the rear end of the film 121 appears and the film tension increases, the cartridge holder 92 is fed further ahead toward the film developing section 1. When the detecting piece 95 is detected by the second detector 97, the cutter device 99 is activated and cuts the film 121.

When feeding the film 121 in the above-described manner, the opening 9 is closed by the shutter 10. When the film 121 is cut by the cutter device 99, the cartridge holder 92 retracts being urged by the spring 94. When the cartridge holder 92 retracts and stops, the cartridge 120 falls by inertia from the shutter 10 into a collector box 110.

As described above, the film feeding apparatus according to the present invention is very suitable for use in cases where numerous films have to be developed.

We claim:

1. An apparatus, comprising:

a film setting chamber adapted communicate with a film developing section;

a film feeding chamber having a top with a film cartridge and leader feed slot therein;

a first carrier device provided in said film feeding chamber that is downwardly moveable in said film feeding chamber and adapted to carry a leader with a film cartridge thereunder;

a second carrier device provided in said film feeding chamber that is intermittently moveable in said film feeding chamber and adapted to carry the leader lowered by said first carrier device in said film feeding chamber to a delivery end of said second carrier device;

a third carrier device provided in said film feeding chamber that is adapted to carry the leader from said delivery end of said second carrier device toward said film setting chamber;

a leader guide provided in said film setting chamber that is adapted to guide the leader that has been fed toward said film setting chamber to the film developing section; and an infeed device provided in said film setting chamber that is adapted to feed the leader into the film developing section.

2. The apparatus as claimed in claim 1, wherein said first carrier device comprises a carriage for supporting a bottom edge of the leader and a driving device for moving said carriage vertically toward and away from said slot.

3. The apparatus as claimed in claim 2, wherein said carriage is provided with a support member for supporting the cartridge to prevent it from falling from the leader.

4. The apparatus as claimed in claim 3, wherein said support member has a rear end pivotally connected to said carriage a roller is mounted on said support member at a location in front of and below the center of pivoting motion of said support member, roller guide grooves extend vertically along a vertical path of said carriage and guide said roller to control the position of said support member and a lower portion of each of said roller guide grooves is inclined so as to cause said support member to be swung downward.

5. The apparatus of claim 1, and further comprising:

a detector provided along a path of the leader being carried downward by said first carrier device for detecting the curling amount of the leader; and a control device for controlling said second carrier device based on a detection signal from said detector.

6. The apparatus of claim 1, wherein said second carrier device comprises a pair of leader guide driving devices, said leader guide driving devices each comprising a pair of rotary shafts, pulleys mounted on said rotary shafts at upper arid lower portions thereof, belts around the upper pulleys and the lower pulleys, and a plurality of leader guides each having a vertically elongate support groove to receive one of the side edges of the leader arranged along the upper and lower belts at equal intervals.

7. The apparatus of claim 1, and further comprising:

a detector provided under a path of the leader and cartridge fed by said second carrier device for detecting fall of the cartridge; and an alarm for giving an alarm upon the fall of the cartridge based on a detection signal of said detector.

8. The apparatus of claim 6, and further comprising:

a first detector for detecting a leader or cartridge that is supported by one of said leader guides facing said first carrier device;

a second detector for detecting a leader or cartridge supported by one of said leader guides facing said third carrier device; and a control means for moving said leader guides toward said first carrier device until a leader or cartridge is detected by said first detector and then moving said leader guides by one pitch toward said third carrier device if the supply of leaders into said slot is temporarily stopped and then resumed and as a result no leader or cartridge is detected by said first detector while said second detector detects a leader or cartridge.

9. The apparatus of claim 8, wherein said control means receives detection signals from said first and second detectors and computes one of a) the number of leaders arranged on said leader guide driving devices, and b) the number of leaders which can be supplied to said leader guide driving devices.

10. The apparatus of claim 9, and further comprising an indicator for indicating one of a) the number of leaders arranged on said leader guide driving device, and b) the number of leaders which can be supplied to said leader guide driving device.

11. The apparatus of claim 1, wherein said third carrier device comprises a carriage for supporting a bottom edge of the leader and a driving device for moving said carriage up and down.

12. The apparatus of claim 1, and further comprising a film detector provided along a path of the leader carried toward said film setting chamber by said third carrier device for detecting if the film has been pulled out of the cartridge and a control means for controlling said infeed device based on a detection signal from said film detector.

13. The apparatus of claim 12, and further comprising a display for indicating that the film has been pulled out of the cartridge based on said detection signal from said film detector.

14. The apparatus of claim 1, and further comprising:

a detector for detecting whether one leader located immediately behind another leader being carried toward said film setting chamber by said third carrier device is being carried together with the other leader, said detector being provided above the one leader located immediately behind the other leader being carried; and a control means for controlling a drive unit of said third carrier device based on a detection signal of said detector.

* * * * *